US005688748A

United States Patent [19]

Tomizawa

[11] Patent Number: 5,688,748

[45] Date of Patent: Nov. 18, 1997

[54] LUBRICATING OIL COMPOSITION FOR INTERNAL COMBUSTION ENGINES

[75] Inventor: Hirotaka Tomizawa, Saitama, Japan

[73] Assignee: Tonen Corporation, Saitama, Japan

[21] Appl. No.: 592,780

[22] Filed: Jan. 26, 1996

[30] Foreign Application Priority Data

Jan. 31, 1995 [JP] Japan ..... 7-034270

[51] Int. Cl.[6] ..... C10M 135/18

[52] U.S. Cl. ..... 508/363; 508/371

[58] Field of Search ..... 508/363, 365, 508/371; 585/4

[56] References Cited

U.S. PATENT DOCUMENTS

| | | | |
|---|---|---|---|
| 4,529,526 | 7/1985 | Inoue et al. | 508/363 |
| 5,281,347 | 1/1994 | Igarashi | 508/363 |

FOREIGN PATENT DOCUMENTS

| | | | |
|---|---|---|---|
| 0113045 | 7/1984 | European Pat. Off. | C10M 1/48 |
| 0281992 | 9/1988 | European Pat. Off. | C10M 101/02 |
| 0418860 | 3/1991 | European Pat. Off. | C10M 169/04 |
| 7034270 | 1/1995 | Japan | C10M 135/00 |
| WO 94/28095 | 12/1994 | WIPO | C10M 135/18 |

*Primary Examiner*—Jacqueline V. Howard
*Assistant Examiner*—Cephia D. Toomer
*Attorney, Agent, or Firm*—Joseph J. Allocca

[57] ABSTRACT

Providing a lubricating oil composition for internal combustion engines which has high resistance to oxidation by nitrogen oxides, excellent friction characteristics that is maintained for a prolonged period, and reduces the fuel consumption for a prolonged period. A lubricating oil composition for internal combustion engines is provided consisting of a base oil principally consisting of a hydrocarbon oil which has a dynamic viscosity of 2–20 $mm^2/s$ at 100° C. and contains 3 wt % or less aromatic components in total, 45 wt% or more one- and two-ring naphthenes in total, 50 wt ppm or less sulfur and 50 wt ppm or less nitrogen, to which are added, with respect to the total weight of the composition, 0.02–0.2 wt % as molybdenum of molybdenum dithiocarbamate, 0.02–0.15 wt % as phosphorus of zinc dithiophosphate, and 0.05–3 wt % of phenol-based antioxidant. The lubricating oil composition according to the invention has a low friction coefficient, which is maintained for a prolonged period even after oxidation by nitrogen oxides.

7 Claims, No Drawings

LUBRICATING OIL COMPOSITION FOR INTERNAL COMBUSTION ENGINES

FIELD OF THE INVENTION

The present invention relates to lubricating oil compositions. More specifically, it relates to lubricating oil compositions for internal combustion engines which are highly resistant to oxidation by nitrogen oxides, and maintain low friction for a prolonged period.

DESCRIPTION OF THE RELATED ART

Lubricating oils have been used for smooth operation of internal combustion engines, power transmission components including automatic transmissions, shock absorbers and power steering devices and gears. Particularly, lubricating oils for internal combustion engines (engine oils) not only lubricate various sliding interfaces, for example, between the piston ring and cylinder liner, in bearings of the crank shaft and the connecting rod, and in the valve driving mechanism including cams and valve lifters, but also cool the engine, clean and disperse combustion products, and prevent rusts and corrosion. Multifarious functions are thus required of the engine oil, and such requirements have been getting more stringent due to enhanced engine performance, increased power, and more severe driving conditions. Engine oils are deteriorated by oxygen and nitrogen oxides contained in the blow-by gas, which is a part of combustion gas leaking from between the piston and cylinder into the crank case. The concentration of the nitrogen oxide in the blow-by gas has been increased in the recent high-performance engines. To control deterioration in an atmosphere containing nitrogen oxides while meeting requirements described above, various additives are used in engine oils, including antiwear agents, metal cleaners, ash-free detergent dispersants and antioxidants.

Among the basic performance of the lubricating oil for internal combustion engines, smoothing the operation of the engine under any conditions, and preventing wear and seizure are particularly important. While most lubricated locations of an internal combustion engine are hydrodynamically lubricated, the boundary lubrication regime tends to appear in valve mechanisms and at the upper and lower dead points of the piston. To prevent wear under the boundary lubrication regime, zinc dithiophosphate, is usually added to the lubricating oil.

Since much energy is lost in the internal combustion engine at fictioning parts associated with the lubricating oil, various additives, including fiction modifiers, are employed in the lubricating oil to reduce fiction loss and fuel consumption (see for example JP03-23595).

However, friction modifiers proposed hitherto, in combination with other additives, have proved to be incapable of maintaining low fiction for a prolonged period.

The purpose of the present invention is to provide, in this circumstance, a lubricating oil composition for internal combustion engines which has excellent fiction characteristics and high resistance to oxidation by nitrogen oxides, and maintains low fiction and low fuel consumption for a prolonged period.

SUMMARY OF THE INVENTION

It has been discovered that prolonged corrosion resistance and low fiction can be endowed to engine oils by adding specified amounts of a particular organomolybdenum compound, an organozinc compound and a phenol-based antioxidant to a base oil principally consisting of a hydrocarbon oil with particular characteristics containing low concentrations of aromatic components and high concentrations of one- and two-ring naphthenes in total.

DETAILED DESCRIPTION OF THE INVENTION

The invention provides a lubricating oil composition for internal combustion engines consisting of a base oil principally consisting of a hydrocarbon oil which has a dynamic viscosity of 2–20 $mm^2/s$ at 100° C. and contains 3 wt % or less aromatic components in total, 45 wt % or more one- and two-ring naphthenes in total, 50 wt ppm or less sulfur and 50 wt ppm or less nitrogen, to which are added, with respect to the total weight of the composition, 0.02–0.2 wt % as molybdenum of molybdenum dithiocarbamate, 0.02–0.15 wt % as phosphorus of zinc dithiophosphate, and 0.05–3 wt % of phenol-based antioxidant.

The lubricating oil composition according to the invention is characterized by a base oil principally consisting of a hydrocarbon oil which has a dynamic viscosity of 2–20 $mm^2/s$ at 100° C. and contains 3 wt % or less aromatic components in total, 45 wt % or more one- and two-ring naphthenes in total, 50 wt ppm or less sulfur and 50 wt ppm or less nitrogen.

The dynamic viscosity of the base oil at 100° C. should be 2–20 $mm^2/s$, or preferably 3–10 $mm^2/s$, or still more preferably 3–8 $mm^2/s$. A dynamic viscosity less than 2 $mm^2/s$ leads to incomplete off films and high evaporation loss, while that exceeding 20 $mm^2/s$ results in excessive power loss due to viscosity resistance.

The concentration of aromatics in the base oil should be 3 wt % or lower, or preferably 1.5 wt % or lower. A concentration exceeding 3 wt % results in lower resistance of the lubricating oil composition at high temperatures to oxidation by nitrogen oxides. The concentrations of aromatics mentioned in the present invention are values obtained by analysis according to ASTM D2549. Aromatics include alkylbenzenes, naphthenebenzenes, anthracene, and fused benzene rings.

The total concentration of one- and two-ring naphthenes should be 45 wt % or higher, or preferably 50 wt % or higher. Coexistence of one- and two-ring naphthenes increases the dissolving power of the base oil to additives and contributes to improvement in the friction characteristics. A total concentration of one- and two-ting naphthenes less than 45 wt % results in insufficient solubility of molybdenum dithiocarbamate and sludge formed in oxidation of the base oil by nitrogen oxides.

The total concentration of one- and two-ring naphthenes is defined by ASTM D2549, and determined by gas chromatography and mass spectroscopy.

The concentration of sulfur and nitrogen in the base oil should be 50 wt ppm or less each. A higher concentration leads to unsatisfactory resistance to oxidation by nitrogen oxides.

Mineral oils, synthetic oils or mixtures thereof may be used as the base oil as far as the requirements described above are met. Examples of base oil include hydrogenated oil which is obtained by hydrocracking of a starting oil derived from naphthene-based crude oil, paraffin-based crude oil, or mixed crude oil by distillation under normal or reduced pressure. Raffinates obtained by treating said starting oil with an aromatic extraction solvent such as phenol, frufral or N-methylpyrrolidone may also be used as the base oil. Another possibility of base oil is hydrogenated aromatic compounds or other synthetic oils.

Additives employed in the invention are now described below.

Said molybdenum dithiocarbamate is represented by Generic Formula [1] below.

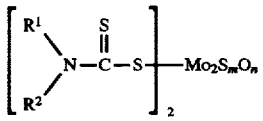

where $R^1$ and $R^2$ are hydrocarbyls with 8–18 carbon atoms, which may be identical with or different from each other; and m and n are positive integers such that their sum is 4.

$R^1$ and $R^2$ in Generic Formula [1] above are hydrocarbyls with 8–18 carbon atoms; examples thereof include straight- or branched-chain alkyls or alkenyls with 8–18 carbon atoms, and cycloalkyls, aryls, alkylaryls or arylalkyls with 8–18 carbon atoms. More specific examples include 2-ethylhexyl, n-octyl, nonyl, decyl, undecyl, dodecyl, tridecyl, tetradecyl, pentadecyl, hexadecyl, heptadecyl, stearyl, oleyl, butylphenyl, and nonylphenyl groups. Preferable hydrocarbyl groups are those with 8–13 carbon atoms.

In the lubricating oil composition according to the invention, molybdenum dithiocarbamate represented by Generic Formula [1] above may be a single compound or a combination of two or more compounds. In the present invention, so much molybdenum dithiocarbamate should be employed as to contribute 0.02–0.2 wt %, or preferably 0.03–0.08 wt %, of molybdenum with respect to the total weight of the composition. A molybdenum concentration less than 0.02 wt % does not reduce friction sufficiently, while a concentration exceeding 0.2 wt % does not result in correspondingly improved friction characteristics and tends to generate sludge.

Zinc dithiophosphate employed in the invention is represented by Generic Formula [2].

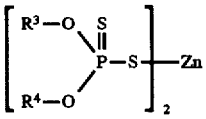

where $R^3$ and $R^4$ are hydrocarbyls with 1–18 carbon atoms, which may be identical with or different from each other.

$R^3$ and $R^4$ in Genetic Formula [2] above are hydrocarbyls with 1–18 carbon atoms; examples thereof include straight- or branched-chain alkyls or alkenyls with 1–18 carbon atoms, and cycloalkyls, aryls, alkylaryls or arylalkyls with 6–18 carbon atoms. More specific examples include methyl, ethyl, propyl, butyl, pentyl, hexyl, heptyl, n-octyl, 2-ethylhexyl, nonyl, decyl, undecyl, dodecyl, tridecyl, tetradecyl, pentadecyl, hexadecyl, heptadecyl, octadecyl, stearyl, oleyl, butyphenyl, and nonylphenyl groups. Preferable hydrocarbyl groups are those with 3–12 carbon atoms.

A preferable concentration of zinc dithiophosphate is such as to contribute 0.02–0.15 wt % of phosphorus with respect to the total weight of the composition.

The invention imposes no particular restriction on the phenolic antioxidant, which may be, for example, alkylphenols, bisphenols and sulfur-containing phenols, such as:

2, 6-di-tert-butyl-4-methylphenol
octyl-3-(4-hydroxy-3,5-di-tert-butylphenyl)propionate
octadecyl-3-(4-hydroxy-3,4-di-tert-butylphenyl) propionate
2,6-di-tert-butyl-4-ethylphenol
2,4-di-tert-butyl-6-methylphenol
2,6-dimethyl-4-tert-butylphenol
2,4-dim ethyl-6-tert-butylphenol
2,4-dimethyl-6-n-butylphenol
2,4,6-trimethylphenol
2-tert-butyl-4-methylphenol
2,4-dimethyl-6-isobutylphenol
2,4-dimethyl-6-sec-butylphenol
2-tert-butyl-4-n-butylphenol
2,4,6-tri-tert-butylphenol
4,4'-methylenebis (2,6-di-tert-butylphenol)
4,4'-thiobis(6-tert-butyl-o-cresol)
4,4'-bis(2,6-di-tert-butylphenol)
2,2'-methylenebis(4-methyl-6-tert-butylphenol)
2,2'-methylenebis(4-ethyl-6-tert-butylphenol)
4,4'-butylydenebis(3-methyl-6-tert-butylphenol)
triethylene glycol bis-3 (3-tert-butyl-5-methyl-4-hydroxyphenyl)propionate
1,6-hexanediol bis-3-(3,5-di-tert-butyl-4-hydroxyphenyl) propionate
4,4'-thiobis (3-methyl-6-tert-butylphenol)
2,2'-thiobis (4-methyl-6-tert-butylphenol)
bis(3-methyl-4-hydroxy-5-tert-butylbenzyl)sulfide
bis(3,5-di-tert-butyl-4-hydroxybenzyl)sulfide
2,2'-thio-diethylenebis[3-(3,5-di-tert-butyl-4-hydroxyphenyl)propionate]
2,6-di-tert-α-dimethyl-amino-p-cresol
2,6-di-tert-butyl-4-(N,N'-dimethylaminomethylphenol)

The invention employs 0.05–3 wt %, or preferably 0.1–2 wt %, of phenolic antioxidant with respect to the total weight of the composition. A concentration less than 0.05 wt % does not give sufficient stability against oxidation, nor assures prolonged friction-reducing effect, while a concentration exceeding 3 wt % does not bring about effects corresponding to the amount.

Other additives usually employed in lubricating oils are selected from the group consisting of additives such as amine-based antioxidants, metal cleaners, ash-free detergent dispersants, other antiwear agents, viscosity index improvers, pour point depressants, antirust agents, anticorrosion agents, defoamers, or other antioxidants, and mixtures thereof may be further added as necessary to the lubricating off composition according to the invention, as far as such additives do not counteract the purpose of the invention.

Amine-based antioxidants include diarylamines such as p,p'-dialkyldiphenylamines, phenyl-α-naphthylamine, alkylphenyl-α-naphthylamine, of which 0.05–3 wt % may usually be added.

Metal cleaners include calcium sulfonate, magnesium sulfonate, barium sulfonate, calcium phenate, barium phenate, calcium salicylate, and magnesium salicylate of which 0.1–5 wt % may usually be added.

Ash-free detergent dispersants include compounds based on succunimide, succinamide, benzylamine and its boron derivative, and esters, of which 0.5–7 wt % may usually be added.

Other fiction reducing agents include thiophosphates of metals (e.g., Pb, Sb, Mo), thiocarbamates of metals (e.g., Zn), sulfur compounds, phosphate and phosphite esters, of which 0.05–5.0 wt % may usually be added.

Viscosity index improvers include compounds based on polymethacrylate, polyisobutylene, ethylene-propylene copolymer, and hydrogenated styrene-butadiene copolymer, of which 0.5–35 wt % may usually be added.

Antirest agents include polyalkenylsuccinie acid and partial esters thereof; anticorrosion agents benzotriazole and benzimidazole; and defoamers dimethylpolysiloxane and polyacrylates, which may be added as necessary.

EXAMPLES

The invention is now further illustrated by Examples, which should not be viewed as limiting the scope of the invention.

The friction coefficients and resistance to oxidation by nitrogen oxides were evaluated by the following methods.

(1) Friction tests

A reciprocal sliding fiction tester (SRV friction tester) was used to determine the friction coefficient (μ) under the following conditions: frequency 50 Hz, amplitude 3 mm, load 25 N, temperature 80° C., and testing time cycle 25 minutes.

(2) Oxidation resistance tests by nitrogen oxides gas

Air containing 1 vol % of nitrogen oxides was blown at a rate of 2 l/h for 8 h into 150 ml of the oil specimen heated to 130° C.

EXAMPLES 1–6 AND COMPARATIVE EXAMPLES 1–6

Base oils shown in Table 1 were used to prepare lubricating oil compositions shown in Table 2. The friction coefficients (μ) of the oil specimens were determined immediately after preparation and after oxidation tests. Results are presented in Table 2.

The results indicate that Examples 1–6 according to the invention have low friction coefficients, while Comparative Examples 1–6 present far higher friction coefficients after oxidation by nitrogen oxide, although those immediately after preparation are low, which means that the Comparative Examples do not maintain the low friction coefficients for a prolonged period.

Lubricating oil compositions according to the invention has high resistance to oxidation by nitrogen oxides immediately after preparation, and maintains a low friction coefficient even after oxidation by nitrogen oxides, thus offering particularly favorable characteristics as lubricating oil for automotive internal combustion engines.

TABLE 1

| Base Oil | Dynamic Viscosity ($mm^2/s$, at 100° C.) | Aromatic Content (wt %) | Total Content of One- and Two-Ring Naphthenes (wt %) | Sulfur Content (wt ppm) | Nitrogen Content (wt ppm) |
|---|---|---|---|---|---|
| 70N | 3.1 | 1.1 | 54 | 1.0 | 1.0 |
| 150N-1 | 5/4 | 0.3 | 57 | 0.5 | 1.0 |
| 150N-2 | 5.5 | 5.0 | 47 | 15.0 | 8.0 |
| 150N-3 | 5.4 | 2.0 | 49 | 130.0 | 20.0 |
| 150N-4 | 5.6 | 2.5 | 48 | 11.0 | 89.6 |
| 150N-5 | 5.6 | 0.5 | 34 | 35.0 | 11.0 |

TABLE 2

| | EXAMPLE | | | | | | COMPARATIVE EXAMPLE | | | | | |
|---|---|---|---|---|---|---|---|---|---|---|---|---|
| | 1 | 2 | 3 | 4 | 5 | 6 | 1 | 2 | 3 | 4 | 5 | 6 |
| Base oil | 70N | 150N-1 | 150N-1 | 150N-1 | 150N-1 | 150N-1 | 150N-2 | 150N-3 | 150N-4 | 150N-5 | 150N-1 | 150N-1 |
| Mo content from $C_8$-MoDTC (wt %) | 0.06 | 0.06 | 0.06 | 0.06 | 0.06 | 0.06 | 0.06 | 0.06 | 0.06 | 0.06 | 0.06 | 0.06 |
| P content from $C_8$-ZnDTP (wt %) | 0.10 | 0.10 | 0.10 | 0.10 | 0.10 | 0.15 | 0.10 | 0.10 | 0.10 | 0.10 | | 0.10 |
| Octyl-3-(4-hydroxy-3,5-di-tert-butylphenyl) propionate (wt %) | 1.0 | 1.0 | | 0.52 | 2.0 | | 1.0 | 1.0 | 1.0 | 1.0 | 1.0 | |
| 2,6-di-tert-butyl-4-methylphenol (wt %) | | | 0.58 | | | 0.58 | | | | | | |
| Friction coefficient (immediately after preparation) | 0.092 | 0.090 | 0.091 | 0.090 | 0.091 | 0.092 | 0.093 | 0.092 | 0.091 | 0.095 | 0.100 | 0.092 |
| Friction coefficient (after oxidation with NOx (at 130° C.) for 8 hours) | 0.094 | 0.093 | 0.093 | 0.095 | 0.093 | 0.094 | 0.134 | 0.127 | 0.136 | 0.130 | 0.182 | 0.134 |

What is claimed is:

1. A lubricating oil composition for internal combustion engines comprising a major mount of a base oil consisting of a hydrocarbon oil which has a dynamic viscosity of 2–20 $mm^2/s$ at 100° C. and contains 3 wt % or less aromatic components, 45 wt % or more one- and two-ring naphthenes, 50 wt ppm or less sulfur and 50 wppm or less nitrogen, and a minor mount of additive mixture comprising 0.02–0.2 wt % as molybdenum of molybdenum dithiocarbamate, 0.02–0.15 wt % as phosphorus of zinc dithiophosphate, and 0.05–3 wt % of phenol-based antioxidant, all concentrations having with respect to the total weight of the composition.

2. The lubricating oil composition of claim 1 wherein the molybdenum dithiocarbamate is of the formula

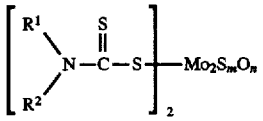

wherein $R^1$ and $R^2$ are the same or different $C_8$-$C_{18}$ hydrocarbyl groups and m and n are positive integers such that their sum is 4.

3. The lubricating oil composition of claim 1 or 2 wherein the molybdenum concentration is in the range 0.03 to 0.08 wt % molybdenum with respect to the total weight of the composition.

4. The lubricating oil composition of claim 1 wherein the zinc dithiophosphate is of the formula

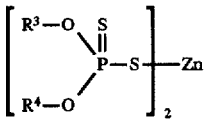

where $R^3$ and $R^4$ are the same or different $C_1$-$C_{18}$ hydrocarbyls.

5. The lubricating oil composition of claim 1, 2 or 4 wherein the phosphorus concentration is in the range 0.02–0.15 wt % phosphorus with respect to the total weight of the composition.

6. The lubricating oil composition of claim 1, 2 or 4 wherein the phenol based antioxidant is present in an amount in the range 0.1 to 2 wt % phenolic antioxidant with respect to the total weight of the composition.

7. The lubricating oil composition of claim 1, 2 or 4 further containing additional additives selected from the group consisting of amine based antioxidants, metal cleaners, ash-free detergents, dispersants, antiwear agents, viscosity index improvers, pour point depressants, anti rust agents, anticorrosion agents, defoamers, antioxidants and mixtures thereof.

* * * * *